United States Patent [19]

Burnett, Jr.

[11] 4,301,762

[45] Nov. 24, 1981

[54] CORN BUTTERING DEVICE

[76] Inventor: Jackson S. Burnett, Jr., 643 Crystal Dr., Spartanburg, S.C. 29302

[21] Appl. No.: 194,472

[22] Filed: Oct. 6, 1980

[51] Int. Cl.[3] ..... B05C 3/09

[52] U.S. Cl. ..... 118/16; 118/25; 118/28; 118/29

[58] Field of Search ..... 118/28, 29, 16, 25, 118/424, 20, 429, 26

[56] References Cited

U.S. PATENT DOCUMENTS

| | | | |
|---|---|---|---|
| 2,808,020 | 10/1957 | Arvidson | 118/13 |
| 2,811,844 | 11/1957 | Selmer | 118/13 X |
| 2,903,997 | 9/1959 | Hay | 118/23 |
| 2,948,260 | 8/1960 | Lubore | 118/13 |
| 3,308,269 | 3/1967 | Stocker | 219/436 |
| 3,362,777 | 1/1968 | Keshock | 401/12 |
| 3,605,684 | 9/1971 | McGinley | 118/13 |
| 3,669,063 | 6/1972 | Daniluke | 118/13 |
| 4,008,681 | 2/1977 | Johnson | 118/13 |

*Primary Examiner*—John P. McIntosh
*Attorney, Agent, or Firm*—Luke J. Wilburn, Jr.; Wellington M. Manning, Jr.; John B. Hardaway, III

[57] ABSTRACT

A corn buttering device for applying a coating of butter or butter substitute to an ear of corn comprising a pan for containing a heated liquid and a receptacle mounted in the pan for containing liquid butter. The pan is provided with a cover which has a recessed upper surface for receiving and supporting an ear of corn therein. The recess in the cover is provided with an elongate slot which communicates with the butter receptacle when the cover is moved downwardly to tilt the receptacle and cause butter to pour through the recess slot and contact an ear of corn. The recess slot is normally closed by a movable wall member which is displaced from the slot during downward movement of the cover on the pan. The cover containing an ear of corn therein is maintained in an upper position on the pan until manually displaced to a lowermost position for applying butter to the corn.

8 Claims, 4 Drawing Figures

CORN BUTTERING DEVICE

The present invention relates to apparatus for applying a coating of butter or butter substitute material to an ear of corn, and, more particularly, to a device for automatically applying amounts of liquid butter to an ear of corn which also functions as a serving dish to support an ear of corn and maintaing the same warm during consumption.

BACKGROUND OF THE INVENTION

A number of devices specifically designed for buttering corn on the cob appear in the patented art. Exemplary of such devices are disclosed in the following U.S. Pat. Nos. 2,811,844; 2,903,997; 3,362,777; and 3,669,063.

Generally, such devices as described in the aforementioned patents include means for supporting an ear of corn and/or a stick or pats of solid butter such that the butter is applied to a hot ear of corn by manipulation of the butter holder about the ear or by rotation of the ear of corn in a corn holder. Such devices depend upon the heat of cooked ears of corn to melt the butter and form a coating on the ear. Obviously, if the ear of corn cools before or during use of the butter applicator, difficulties are encountered in proper application of the butter to the ear.

Certain buttering devices exemplified in U.S. Pat. Nos. 3,605,685 and 4,008,681 employ heating means and a rotatable cylindrical roller to melt and apply liquid butter to bread. However, it is believed that such devices are not particularly suited for buttering corn on the cob or for conveniently supporting the same during mealtime consumption.

BRIEF OBJECTS OF THE PRESENT INVENTION

It is an object of the present invention to provide a device for buttering and serving buttered corn on the cob in an efficient, reliable manner, which device functions as a support for the corn on a dining table during the consumption of the same.

It is a further object to provide a corn buttering device for supplying desired amounts of liquid butter or butter substitute into a recess configured to receive and support an ear of corn which maintains the corn warm during consumption and is easily manipulated by the user during mealtime activities.

BRIEF DESCRIPTION OF THE DRAWINGS

The above, as well as other objects of the invention will become more apparent, and the invention will be better understood from the following detailed description of a preferred embodiment of the invention, when taken together with the accompanying drawings, in which.

DESCRIPTION OF PREFERRED EMBODIMENTS

Figure 1:
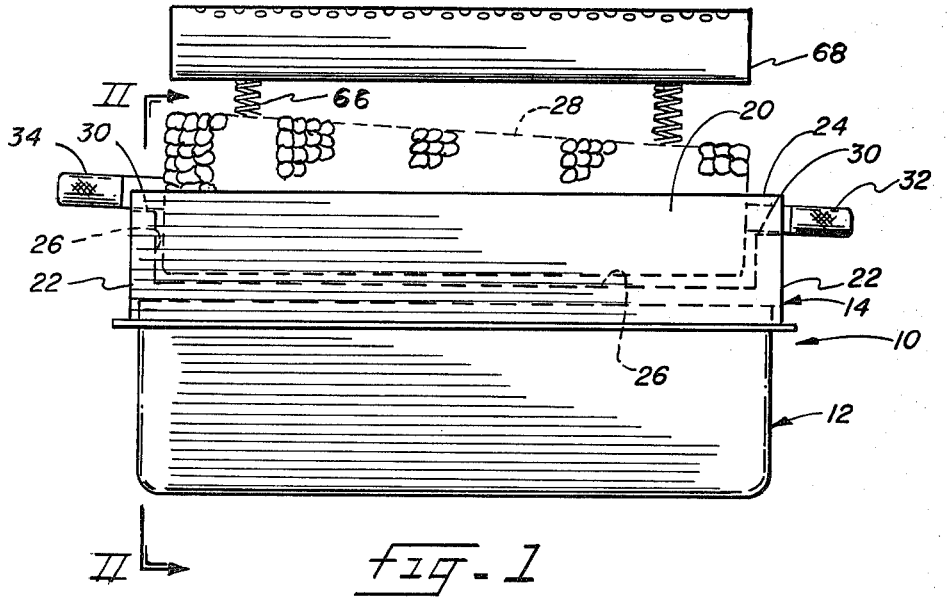
FIG. 1 is a side elevation view of a corn buttering device of the present invention, illustrating in broken lines an ear of corn supportably received in a recess in the removable lid or cover of the device.
Figure 2:
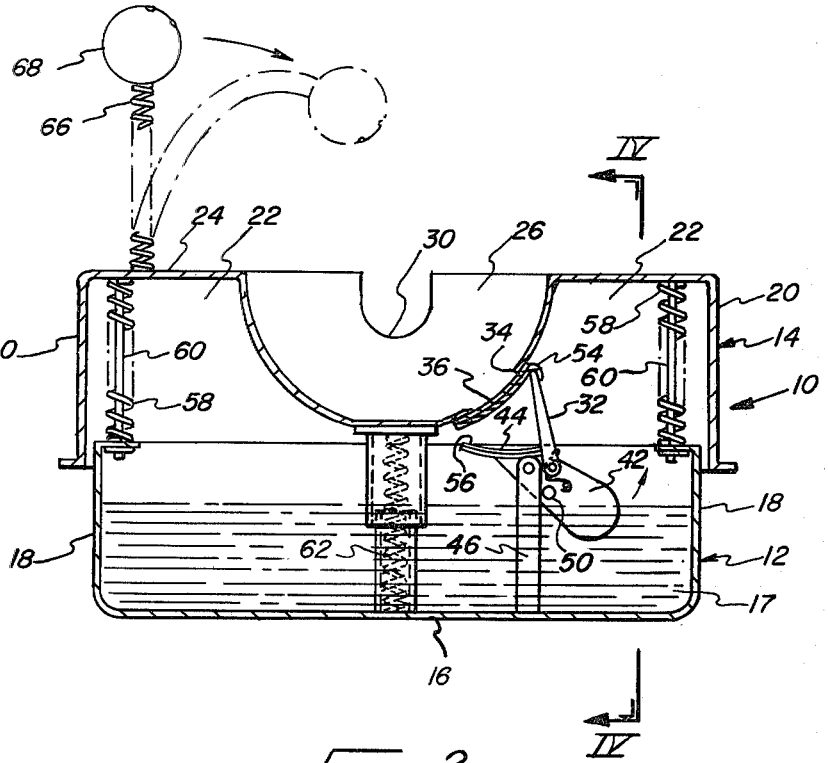
FIG. 2 is a sectional elevation view of the buttering device, taken generally along line II—II of FIG. 1 and looking in the direction of the arrows.

Referring more specifically to the drawings, FIG. 1 shows, in side elevation, the corn buttering and serving device 10 of the present invention. The device 10 comprises a base support pan 12 having a complementary shaped cover 14 which is telescopically received thereon during use. As seen in FIG. 2, pan 12 of the corn butterer includes a bottom wall 16 and upstanding side walls 18 which form a container for receiving an amount of hot liquid, such as water 17.

As seen in FIGS. 1-4, the cover 14 of the buttering device has depending opposed pairs of side walls 20, 22, respectively, and an upper wall surface 24 having an elongate recess 26 therein which is shaped to supportingly receive an ear of corn 28 therein, Side walls 22 of the cover at the ends of the recess 26 are provided with notches 30 which receive conventional removable holders 32, projections of which are inserted into the ends of an ear of corn to facilitate manual handling of the corn during its consumption.

Figure 3:
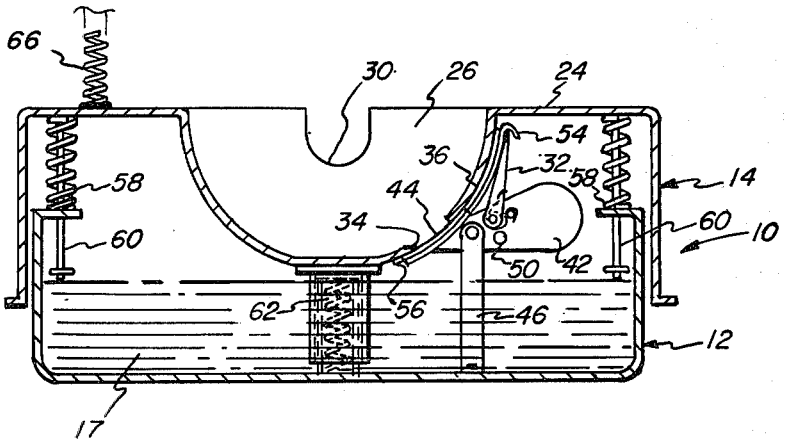
FIG. 3 is a sectional elevation view as in FIG. 2, but showing the cover of the device in a lowermost position on the support pan of the device in which liquid butter is supplied to the corn receiving recess in the cover.
Figure 4:
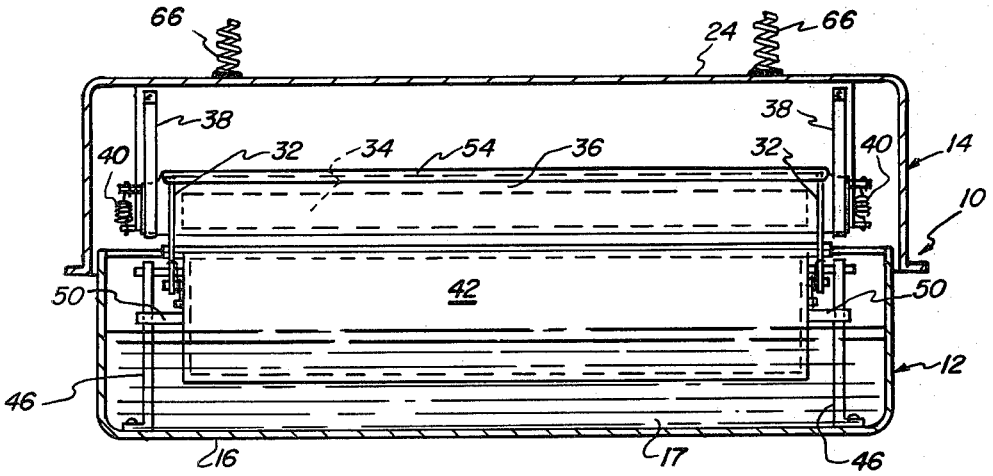
FIG. 4 is a sectional elevational view of the buttering device taken generally along line IV—IV of FIG. 2 and looking in the direction of the arrows.

As seen in FIGS. 2 and 3, the recess 26 in cover 14 is provided with an elongate slot 34 which extends along one side of the recess. A movable wall member 36 normally closes the slot 34 and is supported at each end in guide tracks 38 (FIG. 4) for upward sliding movement to expose the slot during the buttering operation. The movable wall member 36 is biased in a downward direction to close the slot by spring elements 40 (FIG. 4) located adjacent each of the guide tracks 38.

Located within pan 12 to one side of the longitudinal axis thereof is an elongate receptacle 42 having an elongate opening 44 for receiving and dispensing butter or a butter substitute in liquid form therefrom. Butter receptacle 42 is mounted for pivotal movement about its longitudinal axis on upstanding end support posts 46 attached to the bottom wall of the pan which maintain the butter receptacle opening 44 at all times above the level of heated water in the pan. End walls of the receptacle are provided with stop members 50 which engage the support posts 46 to limit pivotal movement of the butter receptacle in clockwise direction as seen in FIGS. 2 and 3, and to permit pivotal movement in counterclockwise direction about its longitudinal axis, as will be explained.

As best seen in FIGS. 2 and 3, the butter receptacle 42 is provided with a pair of upstanding fingers 32 which are pivotally attached to the end walls to engage an upper flanged portion 54 of the movable wall member 36. The lower side edges of the receptacle opening 44 are provided with a gasket 56 which sealingly engages the recess wall surfaces about the slot 34 when the butter receptacle is tilted to dispense liquid butter into the cover recess 26, as seen in FIG. 3.

Suitably attached to inwardly turned flanged edges of side walls of the pan are upstanding resilient springs 58 mounted on slidable support rods which cooperate with a central spring and tube arrangement support member 62 on the bottom wall of the pan 12 to maintain the cover containing the weight of an ear of corn in the recess thereof in an upper position (FIGS. 2) out of contact with the butter receptacle.

To apply liquid butter to an ear of corn, a downward force is applied manually to the corn ear in recess 26, or to the cover, to bring the cover into contact with and tilt the butter receptacle 42 as shown in FIG. 3. At the same time, the fingers 52 on the ends of the butter receptacle displace the movable wall member upwardly to open the slot 34 and communicate the butter dispensing receptacle opening 44 with the slot in fluid tight relationship therewith. In lowermost position of the cover, as seen in FIG. 3, butter flows from the butter dispensing receptacle into the corn-receiving recess of the cover. Upon release of the cover by the user, the cover 14 rises to its uppermost position, the movable wall member 36 moves downwardly to close the slot 34, and the corn is manually rotated in the receptacle to coat the same evenly with liquid butter. If desired, the cover may be removed from the pan and placed on the dining table during use, without fear of loss of butter from the cover recess during consumption of the corn.

As seen in FIGS. 1 and 2 of the drawings, mounted on the upper wall surface of cover 20 of the buttering device on flexible resilient support members such as springs 66, is a dispenser 68 having openings for discharging salt or other seasoning material onto an ear of corn 28 in the recess 26 of the cover. The dispenser is employed by manually displacing the same to a position over the corn ear, and release of the dispenser permits its return to a position adjacent the cover recess.

The corn buttering device may be constructed of various material, such as metal, plastic or the like, and the pan 12 and/or cover 14 containing the hot liquid 17 may be suitably insulated, or the device received within a separate insulated container or cover, to facilitate retention of the heat during use of the device.

From the foregoing description of the invention, it can be seen that the apparatus of the present invention permits the application of liquid butter to an ear of corn by a user in amounts as the user desires for his personal tastes. By utilizing liquid butter which is continuously warmed and heated by the hot water in the pan, the heat of the ear of corn is not required to melt the butter for uniformly coating the ear. In addition, when the cover of the butter dispensing device is maintained on the pan, the corn is maintained warm by the hot water in the pan.

That which is claimed is:

1. Apparatus for applying a coating of butter or butter-substitute to an ear of corn comprising a pan for containing a heated liquid, a generally elongate open-topped receptacle for containing liquid butter mounted in said pan above the bottom thereof for pivotal movement about a longitudinal axis of the receptacle, a cover for said pan having an elongate recess in the upper surface thereof for receiving an ear of corn therein, an elongate slot in one side of the recess for communication with said open-topped receptacle when said cover is lowered in covering relation with said pan, and said cover being engageable with said receptacle when the cover is moved downwardly toward the pan to cause pivotal movement of the receptacle about is longitudinal axis and into communication with the cover slot to discharge liquid butter from the receptacle opening into the corn-receiving recess of the cover.

2. Apparatus as defined in claim 1 wherein said cover includes a movable wall member normally closing said slot, and means on said receptacle for displacing the wall member to expose the slot for communcation with the receptacle opening when the cover is lowered into engagement with the receptacle.

3. Apparatus as defined in claim 2 wherein said displacing means comprises finger means on said receptacle engageable with said movable wall member to slidably move the wall member to expose the slot.

4. Apparatus as defined in claim 1 including means operatively associated with said cover and pan for supporting said cover with an ear of corn in the recess thereof in an upper position on said pan out of engagement with said receptacle until additional force is applied downwardly on the cover.

5. Apparatus as defined in claim 1 wherein said cover-supporting means comprises spring means between said cover and pan for resiliently biasing said cover in an upward direction away from the pan.

6. Apparatus as defined in claim 5 including slots in opposite side walls of said cover adjacent ends of said recess for receiving end-supporting elements for the ear of corn disposed in the recess of the cover.

7. Apparatus as defined in claim 1 including gasket means on an edge portion of said receptacle for sealingly engaging the undersurface of said cover adjacent the recess slot to prevent spilling of liquid butter from the receptacle into the pan during its communication with the slot.

8. Apparatus as defined in claim 1 including dispenser means supportably mounted on said cover for movement to dispense seasoning materials onto an ear of corn in said cover recess.

* * * * *